US007114429B1

(12) United States Patent
Roethlisberger

(10) Patent No.: US 7,114,429 B1
(45) Date of Patent: Oct. 3, 2006

(54) POWER STEERING ASSIST APPARATUS AND METHOD OF RETROFITTING

(75) Inventor: Jeffrey J. Roethlisberger, Saginaw, MI (US)

(73) Assignee: Turn One, Inc., Saginaw, MI (US)

( * ) Notice: Subject to any disclaimer, the term of this patent is extended or adjusted under 35 U.S.C. 154(b) by 76 days.

(21) Appl. No.: 10/947,556

(22) Filed: Sep. 22, 2004

(51) Int. Cl.
*F01B 7/16* (2006.01)
*F15B 9/10* (2006.01)

(52) U.S. Cl. ..... 91/375 R; 91/533; 92/151

(58) Field of Classification Search ..... 92/59, 92/151, 152; 91/375 R, 375 A, 533
See application file for complete search history.

(56) References Cited

U.S. PATENT DOCUMENTS 3,022,772 A * 2/1962 Zeigler et al. ..... 91/375 A
3,709,099 A 1/1973 Dumeah
3,868,888 A * 3/1975 Rehfeld ..... 91/375 A
3,893,528 A * 7/1975 Rehfeld ..... 180/6.3
4,232,585 A * 11/1980 Shea et al. ..... 91/432
4,625,624 A 12/1986 Adams
4,651,842 A 3/1987 Rosell
5,080,186 A 1/1992 Elser et al.
5,855,142 A * 1/1999 Bodtker et al. ..... 74/424.87

* cited by examiner

*Primary Examiner*—Edward K. Look
*Assistant Examiner*—Michael Leslie
(74) *Attorney, Agent, or Firm*—Reising, Ethington, Barnes, Kisselle, PC

(57) ABSTRACT

A power steering assembly and method of retrofitting therefore includes a housing having a cavity defined therein. A drive member extends axially into the cavity and a first piston and a second piston are received in the cavity for axial reciprocation therein. The first and second pistons define at least in part first and second pairs of chambers. The first pair of chambers receive fluid under pressure to move the first and second pistons toward one end of the housing to rotate the driven shaft in a first direction. The second pair of chambers receive fluid under pressure to move the first and second pistons toward the other end of the housing to rotate the driven shaft in a second direction opposite the first direction.

16 Claims, 3 Drawing Sheets

POWER STEERING ASSIST APPARATUS AND METHOD OF RETROFITTING

FIELD OF THE INVENTION

This invention relates generally to vehicle steering systems and more particularly to a power steering assist apparatus that facilitates turning wheels on a vehicle.

BACKGROUND OF THE INVENTION

Modern day automotive vehicles generally have power steering systems that reduce the input force required to turn or steer a vehicle. Though the power steering systems generally enable the operator to relatively easily turn a steering wheel, occasionally, various factors inhibit the operator's ability to turn the steering wheel. For example, if the load on the wheels of the vehicle is increased, particularly over the wheels of the vehicle that turn, such as by attaching a plow or blade to a front end of the vehicle, the assist provided by the power steering system may be inadequate. This may be exacerbated at slow vehicle speeds. In another example, if the operator is driving the vehicle off road, particularly over undulating or soft terrain, the assist provided by the power steering system of the vehicle may be inadequate or undesirably low. Accordingly, when a vehicle is frequently used under such challenging driving conditions it may be necessary or desirable to replace the vehicle power steering system with a new power steering system having an increased output torque. This can prove costly and extremely difficult or undesirable for many reasons, including, but not limited to, space constraints and nonconforming components.

SUMMARY OF THE INVENTION

According to one aspect of the invention, a power steering assembly includes a housing having an axis extending between opposite ends, and a cavity defined between the ends. A valve is in fluid communication with the cavity and is operable to direct fluid under pressure to selected locations within the cavity. A drive member extends axially within the cavity, and a driven shaft has an end extending laterally within the cavity and is operably associated with the drive member. A first piston and a second piston are received in the cavity for axial reciprocation between the ends of the housing. The first piston is reciprocated within the cavity at least in part in response to rotational movement of the drive member. The first and second pistons have opposite sides defining at least in part a first pair of chambers and a second pair of chambers. The first pair of chambers receive fluid under pressure to move the first and second pistons toward one end of the housing causing the driven shaft to move in a first direction. The second pair of chambers receive fluid under pressure to move the first and second pistons toward the other end of the housing causing the driven shaft to move in a second direction opposite the first direction.

Another aspect of the invention provides an apparatus adapted for attachment to a primary power steering assembly. The primary power steering assembly has a primary housing defining at least part of a first cavity. A drive member extends axially in a portion of the housing, and a driven shaft extends laterally from the primary housing. The first piston separates opposite fluid chambers within the first cavity and is arranged for axial reciprocation in the primary housing in response to rotational movement of the drive member and in response to fluid delivered under pressure to the chambers on the opposite sides of the piston. The apparatus comprises a secondary housing adapted to be connected to the primary housing and having a second cavity, and a second piston received in the second cavity for axial reciprocation therein. A connecting shaft is coupled to the first piston and to the second piston. Fluid chambers are defined on opposed sides of the second piston and are constructed to receive fluid under pressure and acting on the second piston.

Another aspect of the invention provides a method of retrofitting a primary power steering assembly to increase the output torque of the power steering assembly. The primary power steering assembly includes a primary housing defining at least part of a first cavity, a drive member extending into the primary housing, and an output shaft extending out of the primary housing. The first piston defines in part opposite fluid chambers within the first cavity and is arranged for axial reciprocation in the first cavity in response to rotational movement of the drive member and in response to fluid being delivered under pressure to the chambers on opposite sides of the piston. The method of retrofitting the primary power steering assembly comprises the steps of: providing a secondary housing with a second cavity, a second piston received for axial reciprocation within the second cavity, and a connecting shaft having one end attached to the second piston attaching one end of the connecting shaft to the first piston; and attaching the secondary housing to the primary housing.

BRIEF DESCRIPTION OF THE DRAWINGS

These and other objects, features and advantages will become readily apparent in view of the following detailed description of the preferred embodiments and best mode, appended claims and accompanying drawings, in which:

DETAILED DESCRIPTION OF THE PREFERRED EMBODIMENTS

Figure 1:
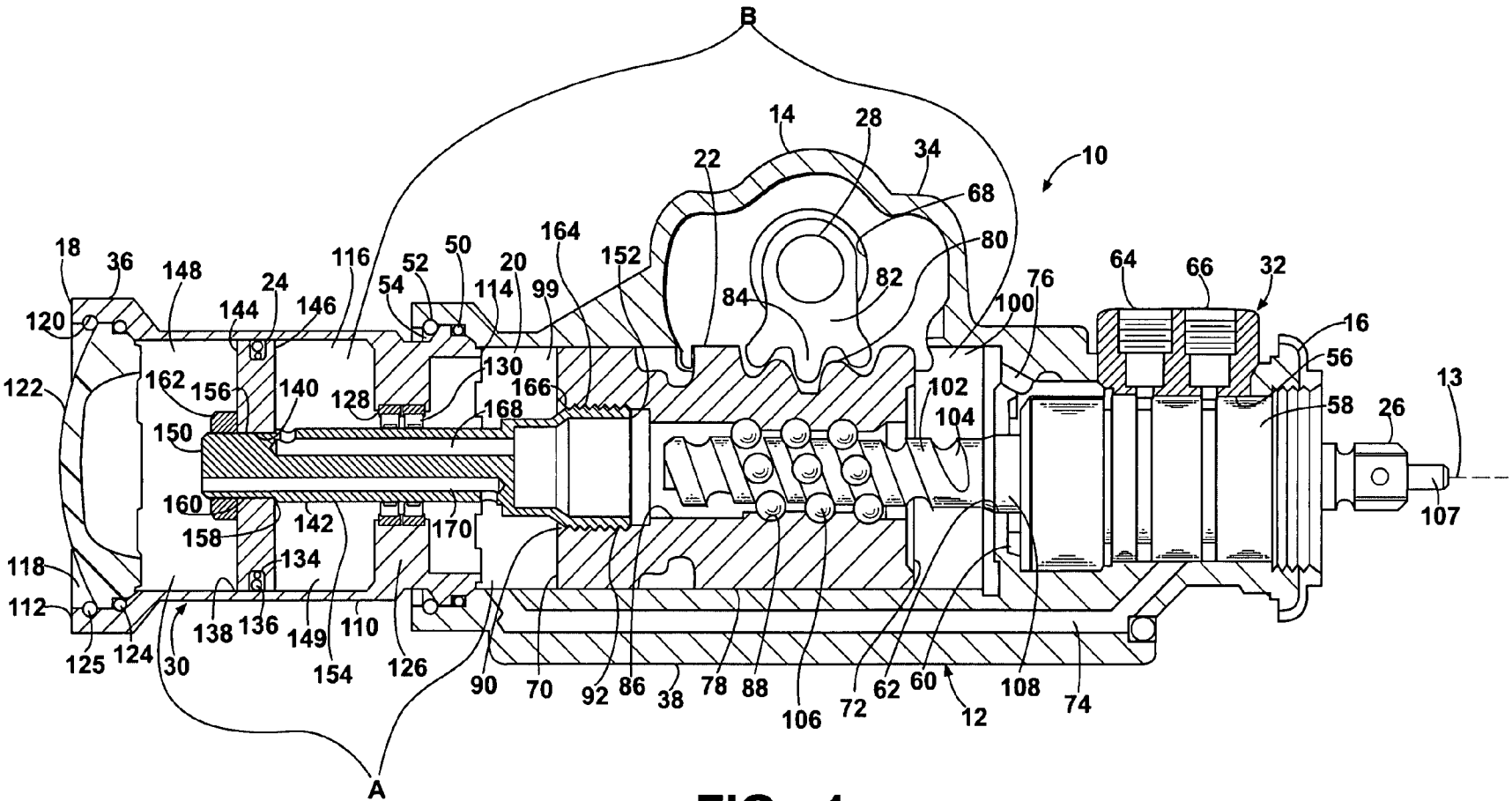
FIG. 1 is a partial cross-sectional view of a power steering assist apparatus constructed according to one presently preferred embodiment of the invention.

Referring in more detail to the drawings, FIG. 1 illustrates a power steering assembly 10 constructed according to one presently preferred embodiment of the invention. The assembly 10 has a housing 12 with an outer wall 14 extending along an axis 13 generally between opposite ends 16, 18 and defining at least one cavity 20 therein. The assembly 10 has a pair of pistons, referred to hereafter as a primary or first piston 22 and an auxiliary or second piston 24, received within the cavity 20 for axial reciprocating movement between the ends 16, 18. The first and second pistons 22, 24 reciprocate within the cavity 20 conjointly with one another in response to rotation of a drive shaft 26, sometimes referred to as a stub shaft, extending axially into the cavity 20 and in response to hydraulic fluid under pressure acting on respective sides of the pistons 22, 24. By having a pair of pistons 22, 24, the surface area upon which the hydraulic fluid can exert pressure is increased, thereby increasing the potential torque output through an output or driven shaft 28 of the assembly 10. Accordingly, the force required to turn the drive shaft 26 for a given output or movement of the driven shaft 28 is reduced, making it easier to turn a vehicle with which the assembly 10 is used.

The power steering assembly 10 could be constructed as an OEM assembly or it could be constructed as an aftermarket assembly. When constructed as an aftermarket assembly, an auxiliary or secondary power steering assist apparatus 30 is attached to a primary power steering assist apparatus 32 already on the vehicle. Regardless of when the assembly 10 is constructed, the housing 12 is desirably constructed having a first portion or primary housing 34 to which a second portion or an auxiliary or secondary housing 36 may be readily attached, though it is contemplated within the scope of the invention that the housing portions could be integrally formed, or formed as more than two pieces. Discussion hereafter assumes an aftermarket condition, wherein the primary power steering assist apparatus 32 is already assembled to the vehicle and the operator is modifying the apparatus 32 by attaching the auxiliary power steering assist apparatus 30 thereto.

Figure 2:
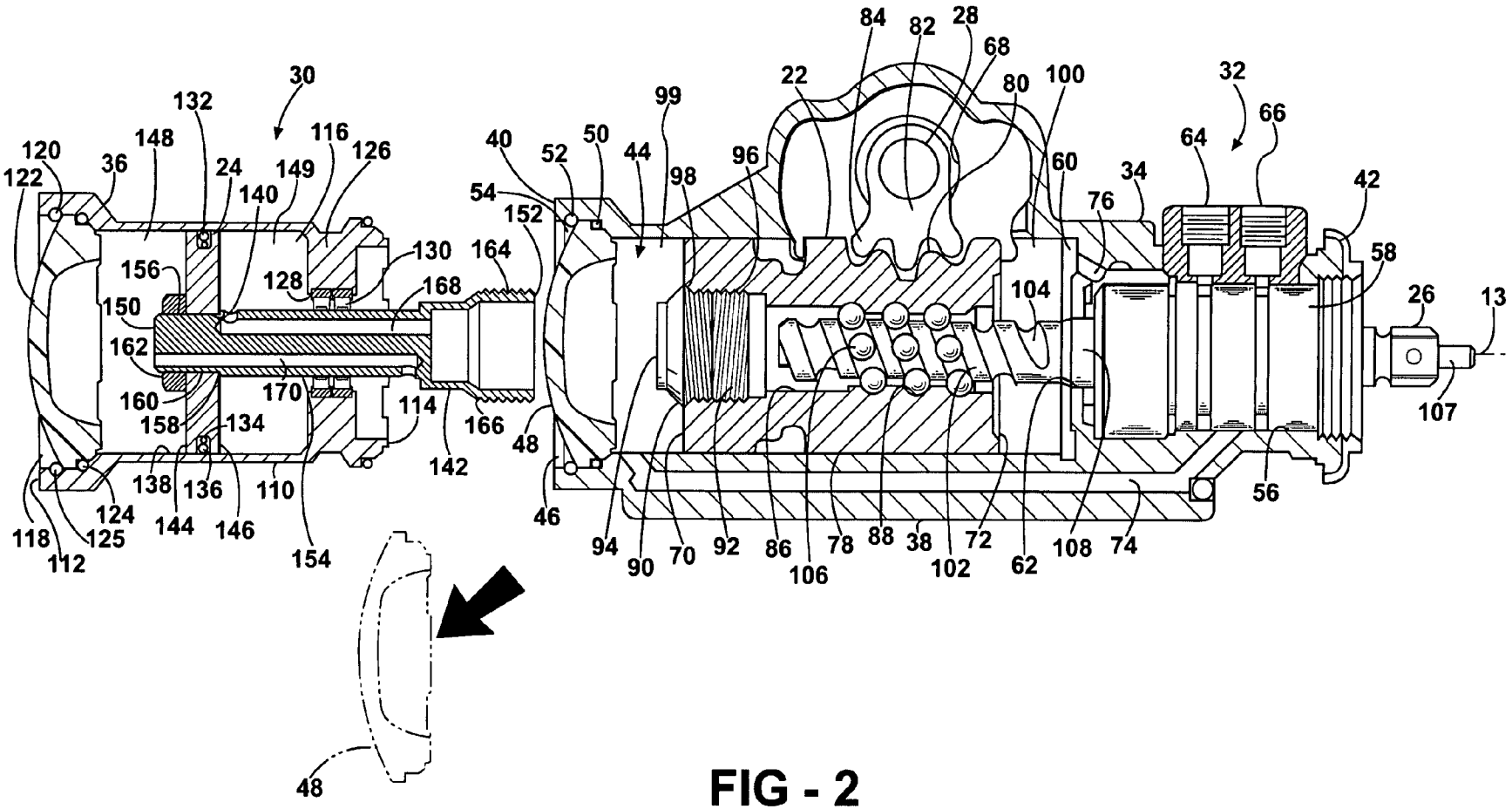
FIG. 2 is a partially exploded view of the power steering assist apparatus of FIG. 1 showing an auxiliary power steering assist apparatus prior to assembly to a primary power steering assist apparatus.

As best shown in FIG. 2, the primary housing 34 of the primary power steering assist apparatus 32 has an outer wall 38 extending between opposite ends 40, 42 with a first or primary cavity 44 defined between the ends 40, 42 to define in part the cavity 20 of the housing 12. One end 40 of the primary housing 34 has a counterbore 46 sized for sealed receipt of an end cap 48. Desirably, an o-ring or seal 50 is received between the end cap 48 and the housing 34, while a snap ring or retainer 52 is received within an annular groove 54 in the counter bore 46 to secure the end cap 48 in sealed engagement with the primary housing 34. The other end 42 of the housing 34 has a valve bore 56 sized for receipt of a rotary valve assembly 58 that may be of conventional construction and is in fluid communication with the primary cavity 44 to direct hydraulic fluid under pressure to selected locations within the primary cavity 44. The valve bore 56 is generally separated from the primary cavity 44 by an intermediate wall 60 or bulk head having an opening 62. The primary housing 34 includes an inlet 64 through which hydraulic fluid from a pump (not shown) enters the rotary valve assembly 58, and an outlet 66 for returning hydraulic fluid to the pump. The outer wall 38 of the primary housing 34 also has spaced openings 68 (only one represented) for journaled receipt of the driven shaft 28, sometimes referred to as a Pitman shaft.

To facilitate directing the flow of hydraulic fluid through the rotary valve assembly 58 to the desired portions of the primary cavity 44 on opposite sides 70, 72 of the primary piston 22, the primary housing 34 has a first fluid passage 74 extending generally axially through a portion of the outer wall 38 between the valve bore 56 and a portion of the primary cavity 44 adjacent the end cap 48. The primary housing 34 has a second fluid passage 76 extending between the valve bore 56 and another portion of the primary cavity 44 adjacent the intermediate wall 60.

The primary cavity 44 is sized for close receipt of the primary piston 22, sometimes referred to as a rack piston or ball nut, for axial reciprocation between the opposite ends 40, 42 of the primary housing 34. The primary piston 22 has an outer surface 78 with teeth 80 extending therefrom for meshed engagement with a sector 82 of generally helical teeth 84 formed adjacent an end of the output shaft 28. The primary piston 22 has a through bore 86 with an internal helical groove 88 formed in a portion of the through bore 86. The side 70 of the primary piston 22 facing the end cap 48 preferably has a seal seat 90 and internal threads 92 formed therein for threaded receipt of an end plug 94 preferably having external threads 96 and a seal seat 98. The end plug 94 closes off one end of the through bore 86 and separates a pair of opposite fluid chambers 99, 100 within the first cavity 44. One of the chambers, referred to hereafter as a first fluid chamber 99 is defined between the end cap 48 and the side 70 of the primary piston 22 facing the end cap 48. The other fluid chamber, referred to hereafter as a second fluid chamber 100 is defined between the intermediate wall 60 and the side 72 of the primary piston 22 facing the valve bore 56. The primary piston 22 is represented here by way of example as being a recirculating ball-type piston to facilitate reducing the friction between the primary piston 22 and a second drive shaft 102, sometimes referred to a worm shaft.

The second drive shaft 102 has an external helical groove 104 sized for receipt in the through bore 86 of the primary piston 22. The grooves 88, 104 are aligned for threaded interaction via a plurality balls 106 received for recirculation between the grooves 88, 104 as is known. An end 108 of the drive shaft 102 is adapted to be operably attached or coupled to the drive shaft 26 and they may collectively be referred to as a drive member. The drive member may comprise one or more than one shaft or other interconnected components as desired. A torsion bar 107 has one end coupled to the drive shaft 26 and another end coupled with the rotary valve assembly 58. As such, rotation of the drive shaft 26 affects conjoint rotation of both the drive shaft 102 and the rotary valve assembly 58 in response to an operator rotating the steering wheel. In use, as the operator rotates the steering wheel, the drive shaft 26 and the drive shaft 102 rotate conjointly in one direction to move the primary piston 22 axially toward one of the ends 40, 42 of the primary housing 34 via the recirculating balls 106 within the respective grooves 88, 104 of the primary piston 22 and the drive shaft 102. Generally, as the primary piston 22 moves to the right, as viewed in FIGS. 1 and 2, a right turn of the vehicle is initiated, and conversely, as the primary piston 22 moves to the left, a left turn of the vehicle is initiated. To facilitate the operator's ability to turn the steering wheel to initiate a right turn, hydraulic fluid is directed under pressure by the rotary valve assembly 58 through the first fluid passage 74 to the first fluid chamber 99, thereby tending to move the primary piston 22 to the right. Conversely, to facilitate the operator's ability to turn the steering wheel to initiate a left turn, hydraulic fluid is directed under pressure by the rotary valve assembly 58 through the second fluid passage 76 to the second fluid chamber 100, thereby tending to move the primary piston 22 to the left. Accordingly, the primary piston 22 provides two surfaces or sides 70, 72 upon which hydraulic fluid under pressure can act to facilitate initiating a right or left turn of the vehicle.

The secondary housing 36 of the auxiliary power steering assist apparatus 30 has an outer wall 110 extending between opposite ends 112, 114 to define a second or auxiliary cavity 116 that defines in part the cavity 20 of the housing 12 when attached to the primary housing 44. One end 112 of the secondary housing 36 is preferably constructed having a same size counter bore 118 and annular groove 120 as formed in the end 40 of the primary housing 34 to receive an end cap 122 as used to seal off the end 40 of the primary housing 34. As such, an o-ring 124 and snap ring 125 as used in the end 40 of the primary housing 34 are also used in combination with the end cap 122 to seal off the end 112 of the secondary housing 36. The other end 114 of the secondary housing 36 has a bulk head or end wall 126. The end wall 126 has an opening 128 constructed for receipt of at least one and shown here as a pair of annular seals 130 and/or bearings therein. The end 114 of the secondary housing 36 is preferably constructed having a geometry generally the same as that of the end cap 48 used for sealing the end 40 of the primary housing 34. Accordingly, upon removing the end cap 48 from the end 40 of the primary housing 34, the end 114 of the secondary housing 36 can be attached to the primary housing 34 through the use of the o-ring 50 and snap ring 52.

The second piston 24 is sized for axial reciprocation within the second cavity 116 of the secondary housing 36. Preferably, the second piston 24 has a peripheral groove 132 sized for receipt of an o-ring 134 therein, wherein the o-ring 134 is preferably formed from an elastomer. Desirably, the groove 132 also receives a seal or piston ring 136 radially outwardly of the o-ring 134, wherein the piston ring is preferably formed from Teflon® to provide sliding sealed engagement with an inner surface 138 of the secondary housing 36. The second piston 24 preferably has a through bore 140 through which a connecting shaft 142 extends. With the second piston 24 received in the second cavity 116, a pair of hydraulic fluid chambers are defined on opposite sides 144, 146 of the second piston 24. In particular, the second piston 24 defines in part a third fluid chamber 148 between the end cap 122 of the secondary housing 36 and one side 144 of the second piston 24, with the third fluid chamber 148 being adapted for fluid communication with the first fluid chamber 99 in the primary housing to define a first pair of fluid chambers (A). A fourth fluid chamber 149 is defined between the end wall 126 of the secondary housing 36 and the other side 146 of the second piston 24, with the fourth fluid chamber 149 being adapted for fluid communication with the second fluid chamber 100 in the primary housing 34 to define a second pair of fluid chambers (B). The end wall 126 of the secondary housing 36 defines in part one of the chambers in each of the first and second pairs of fluid chambers (A, B), shown here as the first and fourth fluid chambers 99, 149.

Figure 4:
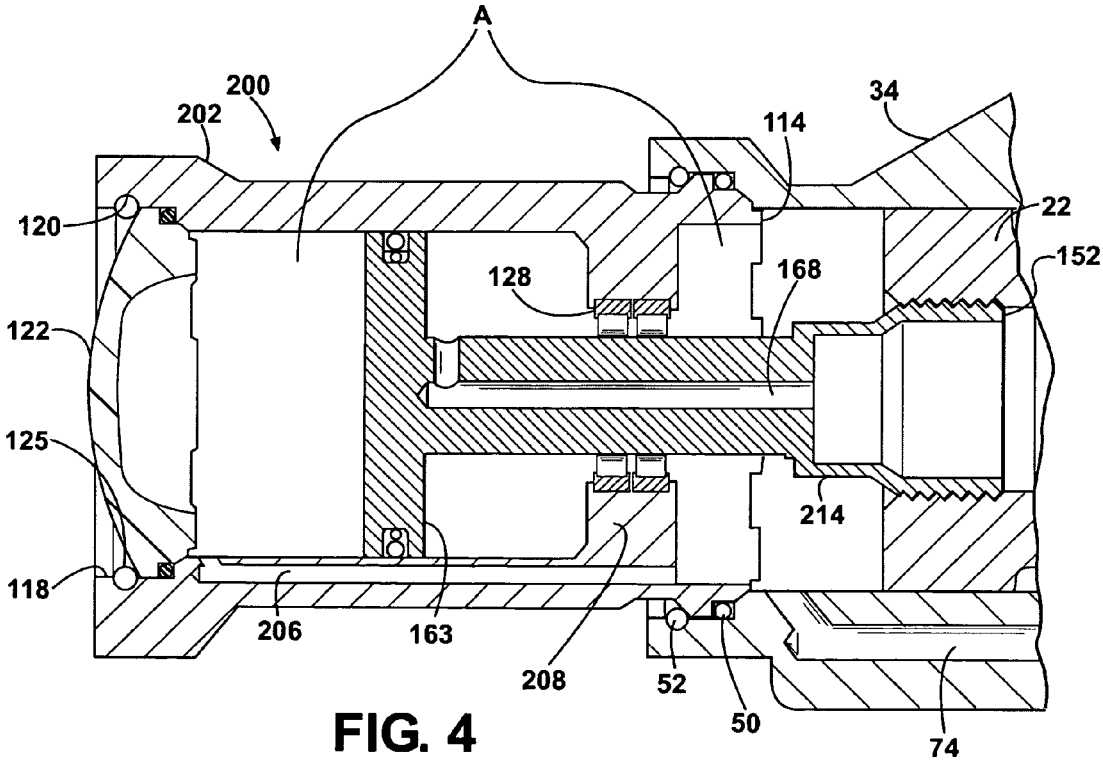
FIG. 4 is a fragmentary sectional view of a power steering assist apparatus constructed according to yet another embodiment of the invention.

The connecting shaft 142 has opposite ends 150, 152 adapted for attachment to the first and second pistons 22, 24 with an outer surface 154 therebetween. At least a portion of the outer surface 154 is sized for receipt in the opening 128 through the end wall 126 of the secondary housing 36 and for a fluid sealed sliding receipt with the seals 130 in the through opening 128. Desirably, the connecting shaft 142 has a reduced diameter portion 156 extending axially from one of the ends 150 to a radially outwardly extending shoulder 158. The reduced diameter portion 156 is preferably sized for receipt in the through bore 140 of the second piston 24. Further, to facilitate attachment of the second piston 24 to the connecting shaft 142, desirably the reduced diameter portion 156 has a threaded portion 160 adjacent the end 150 for receipt of an internally threaded nut 162. Accordingly, in assembly, the second piston 24 is trapped between the shoulder 158 and the nut 162. Other mechanisms for securing the second piston 24 to the connecting shaft 142 are contemplated to be within the scope of this invention, such as having a threaded bore (not shown) in the secondary piston 24 for direct threaded engagement with the threaded portion 160 of the connecting shaft 142, or having a secondary piston 163 being formed as one piece with a connecting shaft 214, as shown in FIG. 4, by way of examples without limitation.

The other end 152 of the connecting shaft 142 preferably is constructed having generally the same shape and configuration as the end plug 94 used to close off the through bore 86 and the first piston 22, including external threads 164 and a seal seat 166 for mating threaded and sealed engagement with the internal threads 92 and seal seat 90 of the first piston 22. As such, with the end plug 94 removed from the first piston 22, the end 152 of the connecting shaft 142 may be readily attached to the first piston 22 for a sealed connection therewith on an opposite side of the end wall 126 from the second piston 24.

To facilitate communicating hydraulic fluid under pressure between at least one of the first and second pairs of fluid chambers (A, B) and between the primary power steering apparatus 32 and the auxiliary power steering apparatus 30, desirably the connecting shaft 142 has a pair of fluid passages 168, 170 therein. One of the fluid passages 168 extends axially from the connecting shaft end 152 partially along the length of the connecting shaft 142 and exits radially outwardly through the outer surface 154 of the connecting shaft 142 into the fourth fluid chamber 149. Accordingly, upon attaching the connecting shaft 142 and the secondary housing 36 to the first piston 22 and primary housing 34, the fluid passage 168 and the through bore 86 in the first piston 22 provides fluid communication between the second pair of fluid chambers (B). The other fluid passage 170 extends axially from the connecting shaft end 150 along at least a portion of the length of the connecting shaft 142 and exits radially outwardly through the outer surface 154 of the connecting shaft 142 generally adjacent the connecting shaft end 150. Accordingly, upon attaching the connecting shaft 142 and secondary housing 36 to the first piston 22, the fluid passage 170 provides fluid communication between the first pair of fluid chambers (A).

Figure 3:
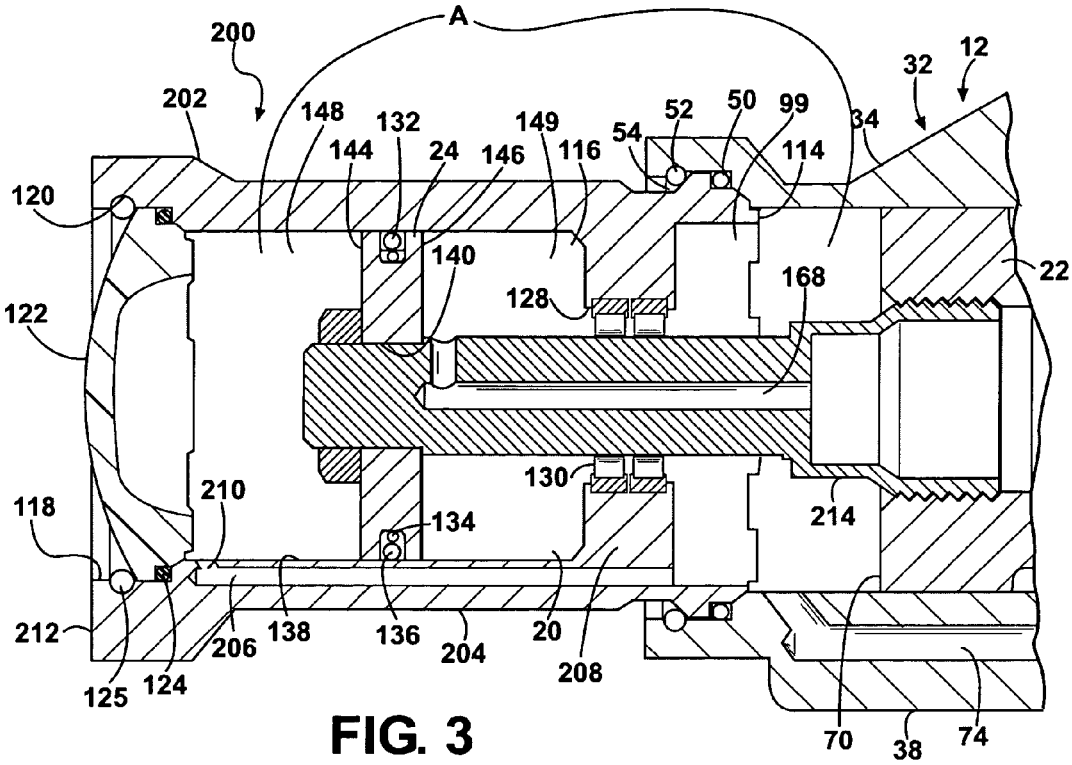
FIG. 3 is a fragmentary sectional view of a power steering assist apparatus constructed according to another embodiment of the invention.

Another presently preferred embodiment of an auxiliary or secondary power steering assist apparatus 200 is shown in FIG. 3. The apparatus 200 is constructed generally similarly to the previous embodiment assembly 10, and thus, the same reference numerals are used to describe like features. The auxiliary power steering assist apparatus 200 has a secondary housing 202 with an outer wall 204. The outer wall 204 has a fluid passage 206 extending from an end wall 208 axially through at least a portion of the outer wall 204. The fluid passage 206 terminates at a radially inwardly extending portion 210 that enters a third fluid chamber 148 generally adjacent an end 212 of the secondary housing 202. Accordingly, the fluid passage 206 communicates the first fluid chamber 99 in the primary housing 34 with the third fluid chamber 148 in the secondary housing 202. The fluid passage is formed in the housing 202 rather than the connecting shaft 142, as in the previous embodiment. Otherwise, the construction of the secondary housing 202 preferably is the same as in the previous embodiment, and thus, is not discussed further.

The auxiliary power steering assist apparatus 200 has the connecting shaft 214 with a single fluid passage 168 for communicating hydraulic fluid under pressure between the second fluid chamber 100 in the primary housing 34 and a fourth fluid chamber 149 in the secondary housing 202. With the connecting shaft 214 having the single fluid passage, it should be recognized that the connecting shaft can have a reduced diameter, and thus, is economical and lightweight in construction. Otherwise, the construction of the connecting shaft 214 preferably is the same as in the previous embodiment, and thus, is not discussed further.

Desirably, an auxiliary power steering assist apparatus may be readily connected to an existing primary power steering assist apparatus 32 to provide additional assist for steering a vehicle. The retrofitting process includes removing the end cap 48 on the primary apparatus 32 by removing the snap ring 52 and then removing the end plug 94 from the primary piston 22. Then, attaching the end 152 of the connecting shaft 142 to the primary piston 22 in place of the end plug 94. As shown in FIG. 4, when the connecting shaft 214 and second piston 163 are a one piece construction, then the second piston 163 is preferably moved toward the end wall 208 to extend the connecting shaft 214 axially outwardly beyond the end 114 of the secondary housing 202 adapted for attachment to the primary housing 34. Thereafter, the end 152 of the connecting shaft 214 is attached to the primary piston 22 in place of the end plug 94, and the secondary housing 202 is attached to the primary housing 34 by installing the o-ring 50 and snap ring 52. It should be recognized that when the connecting shaft 214 is formed as a one piece construction with the second piston 163, the end 152 is preferably sized to fit through the opening in the end wall 208. Further, the end 152 could be attached separately (not shown), such as through a weld joint by way of example and without limitation, to a single piece connecting shaft 214 and second piston 163. Otherwise, if the connecting shaft 142 and second piston 24 are separate components, then the connecting shaft 142 may be attached to the first piston 22 prior to attaching the second piston 24 to the connecting shaft 142. Thereafter, the secondary housing 36, with its end cap 122 removed therefrom, may be attached to the primary housing 36. Next, the second piston 24 may be attached to the connecting shaft 142, and then the end cap 122 can be attached to the end 112 of the secondary housing 36. Regardless of the sequence of steps chosen in assembly, the retrofitting process is relatively easy.

In operation, when the operator initiates a right turn, the rotary valve assembly 58 is rotated via the drive shaft 26 and torsion bar 107 to direct hydraulic fluid under pressure to the first pair of fluid chambers (A). The first and second pistons 22, 24 are caused to move conjointly axially toward the respective ends 42, 114 of their housings 34, 36 in response, at least in part, to the hydraulic pressure acting on their sides 70, 144. As such, the driven shaft 28 is caused to rotate in a first direction to turn the wheels of the vehicle to the right. Conversely, when the operator initiates a left turn, the rotary valve assembly 58 is rotated in an opposite direction to direct hydraulic fluid under pressure to the second pair of fluid chambers (B). The first and second pistons 22, 24 are caused to move conjointly toward the respective ends 40, 112 of their housings 34, 36 in response, at least in part, to the hydraulic pressure acting on their sides 72, 146 facing the drive shaft 26. As such, the driven shaft 28 is caused to rotate in a second direction opposite the first direction to turn the wheels of the vehicle to the left.

It should be recognized that the embodiments of the power steering assist apparatus discussed above are intended to be illustrative of some presently preferred embodiments of the invention, and not limiting. Various modifications within the spirit and scope of the invention will be readily apparent to those skilled in the art. For example and without limitation, it should be recognized that the fluid passages in the connecting shafts and secondary housing may initially be formed as through passages, and thereafter, plugged, as desired, to obtain the desired flow path. Further, the fluid passages may be routed other than as shown to direct hydraulic fluid under pressure to the first and second pairs of fluid chambers (A,B) including with hoses or appropriate passages or conduits that may be at least partially external to the housings 34, 36, 202. The invention is defined by the claims that follow.

I claim:

1. A power steering assembly, comprising:

a housing having an axis extending between opposite ends, and a cavity being defined between the ends;

a valve in fluid communication with the cavity and being operable to direct fluid under pressure to selected locations within the cavity;

a drive member extending axially in the cavity;

a driven shaft extending laterally in the cavity and operably associated with the drive member to be driven in response to movement of the drive member; and a first piston and a second piston received in the cavity for axial reciprocation, the first piston reciprocating in the cavity at least in part in response to rotational movement of the drive member, the first and second pistons having opposite sides defining at least in part a first pair of chambers and a second pair of chambers, the first pair of chambers receiving fluid under pressure through the valve to move the first and second pistons toward one end of the housing and causing the driven shaft to rotate in a first direction, the second pair of chambers receiving fluid under pressure through the valve to move the first and second pistons toward the other end of the housing and causing the driven shaft to rotate in a second direction opposite the first direction.

2. The assembly of claim 1 further comprising a connecting shaft having one end attached to the first piston and having an opposite end attached to the second piston, the connecting shaft having a fluid passage extending axially therein for communicating fluid under pressure between one of the first and second pair of chambers.

3. The assembly of claim 2 wherein the connecting shaft has a pair of passages extending axially therein, one of the passages communicating fluid under pressure between the first pair of chambers to facilitate moving the first and second pistons toward one end of the housing and the other of the passages communicating fluid under pressure between the second pair of chambers to facilitate moving the first and second pistons toward the other end of the housing.

4. The assembly of claim 1 wherein the housing has a first portion defining in part the cavity for receiving the first piston and a second portion defining in part the cavity for receiving the second piston, the first and second portions being constructed as separate pieces from one another and having ends adapted for attachment to one another to define the cavity.

5. The assembly of claim 4 wherein the first and second portions of the housing each have an outer wall with a fluid passage extending therein, the passages being in fluid communication with one another to communicate fluid under pressure between one of the first and second pair of chambers to facilitate moving the first and second pistons toward one of the ends of the housing.

6. The assembly of claim 5 further comprising a connecting shaft connected to the first piston and the second piston, and having a fluid passage extending at least partially therein for communicating fluid under pressure between the other of the first and second pair of chambers to facilitate moving the first and second pistons toward the other of the ends of the housing.

7. The assembly of claim 4 wherein the second portion has an end wall with a through opening, and further comprising a connecting shaft sized for receipt in the through opening and being adapted to be operably attached to the first piston on one side of the end wall and to the second piston on the other side of the end wall, the end wall defining in part one of the chambers in each of the first and second pair of chambers.

8. The assembly of claim 7 further comprising at least one seal between the through opening and the connecting shaft.

9. An apparatus for attachment to a primary power steering assembly having a primary housing defining a first cavity, a drive member extending axially in the primary housing, a driven shaft coupled to the drive member and extending laterally from the primary housing, a first piston received in the first cavity, the first piston separating opposite fluid chambers within the first cavity and being arranged for axial reciprocation in the primary housing in response to rotational movement of the drive member and in response to fluid being delivered under pressure to the chambers on the opposite sides of the piston, the apparatus, comprising:

a secondary housing having an outer wall extending between opposite ends with a second cavity being defined therein, one of the ends being sized for attachment to an end of the primary power steering assembly and having an end wall with a through opening therein;

a second piston being received in the second cavity for axial reciprocation therein;

a connecting shaft sized for receipt in the through opening and adapted to be operably attached to the first piston of the primary power steering assembly on one side of the end wall and to the second piston within the second cavity, the end wall and the second piston defining in part a fluid chamber on one side of the second piston with a separate fluid chamber being defined on the other side of the second piston; and a passage communicating the first cavity with the second cavity.

10. The apparatus of claim 9 wherein the connecting shaft has a fluid passage extending axially therein for communicating fluid under pressure between one of the fluid chambers in the apparatus with one of the fluid chambers in the primary power steering assembly.

11. The apparatus of claim 10 wherein the outer wall of the secondary housing has a fluid passage extending therein for communicating fluid under pressure between the other of the fluid chambers in the apparatus with the other of the fluid chambers in the primary power steering assembly.

12. The apparatus of claim 9 wherein the connecting shaft has a pair of passages extending axially therein, one of the passages communicating fluid under pressure to one side of the second piston and the other fluid passage communicating fluid under pressure to the other side of the second piston.

13. The apparatus of claim 9 wherein the connecting shaft is constructed as a single piece with the second piston.

14. The apparatus of claim 9 wherein the second piston has a through bore and the end of the connecting shaft attached to the second piston has a threaded portion to facilitate attachment of the second piston to the connecting shaft.

15. A method of retrofitting a primary power steering assembly to increase the output torque of the primary power steering assembly, the primary power steering assembly comprising: a primary housing, a first cavity defined at least in part by the housing, an end cap closing one end of the primary housing and a drive member extending axially in a portion of the primary housing;

an output shaft extending laterally from the primary housing and coupled to the drive member, a first piston having a through bore for receipt of the drive member and having an end plug closing off one end of the through bore for separating opposite fluid chambers within the first cavity, the first piston being arranged for axial reciprocation in the primary housing in response to rotational movement of the drive member and in response to fluid being delivered under pressure to the chambers on the opposite sides of the piston, the method comprising the steps of:

removing the end cap from the primary housing;

removing the end plug from the first piston;

providing a secondary housing defining at least part of a second cavity, a second piston received for axial reciprocation within the second cavity with a connecting shaft having one end attached to the second piston and an other end extending from one of the ends of the secondary housing, the connecting shaft having a fluid passage extending axially therein;

attaching the other end of the connecting shaft to the first piston; and attaching the secondary housing to the primary housing.

16. The method of claim 15 wherein the secondary housing is attached to the primary housing in the area wherein the end cap was attached to the primary housing prior to its removal from the primary housing.

* * * * *